United States Patent [19]

Ketner

[11] 4,325,488

[45] Apr. 20, 1982

[54] LIGHTWEIGHT CARGO CONTAINER AND FITTINGS

[75] Inventor: Clyde R. Ketner, Sumner, Wash.

[73] Assignee: The Boeing Company, Seattle, Wash.

[21] Appl. No.: 69,219

[22] Filed: Aug. 23, 1979

[51] Int. Cl.[3] ..... B65D 88/12; B65D 90/08

[52] U.S. Cl. ..... 220/1.5; 24/287; 52/282; 220/80; 410/77

[58] Field of Search ..... 220/1.5, 84, 80, 23.4, 220/23.6, 4 B, 4 E; 24/221 R, 221 RC; 52/282; 217/65; 296/205, 29, 30, 35.1, 35.3; 410/77–86, 96, 101

[56] References Cited

U.S. PATENT DOCUMENTS

| | | | |
|---|---|---|---|
| 1,470,266 | 10/1923 | Kirchner | 410/79 |
| 1,654,225 | 12/1927 | Tanner | 220/4 E X |
| 2,009,614 | 7/1935 | Geyer | 296/30 |
| 3,015,407 | 1/1962 | Fesmire et al. | 220/1.5 |
| 3,044,656 | 7/1962 | Combs et al. | 220/1.5 X |
| 3,125,965 | 3/1964 | De Pent et al. . | |
| 3,140,673 | 7/1964 | Williams . | |
| 3,190,408 | 6/1965 | Peterson . | |
| 3,190,409 | 6/1965 | Peterson . | |
| 3,312,181 | 4/1967 | Davidson | 410/97 |
| 3,338,012 | 8/1967 | Kappenhagen | 52/282 |
| 3,349,533 | 10/1967 | Gregoire | 52/282 X |
| 3,456,829 | 7/1969 | Glassmeyer | 220/1.5 |
| 3,459,326 | 8/1969 | Betjemann | 220/1.5 |
| 3,553,823 | 1/1971 | Alfredsson . | |
| 3,587,900 | 6/1971 | Miller et al. | 220/1.5 X |
| 3,598,273 | 8/1971 | Rau et al. | 220/1.5 |
| 3,692,203 | 9/1972 | Byrd et al. | 220/1.5 |
| 3,715,136 | 2/1973 | Yoshida | 52/285 |
| 3,898,873 | 8/1975 | Glassmeyer | 220/1.5 X |
| 3,955,700 | 5/1976 | Pedraza | 220/1.5 |
| 3,966,075 | 6/1976 | Schultz | 220/1.5 |
| 3,974,616 | 8/1976 | Beckley | 52/282 X |
| 3,989,157 | 11/1976 | Veenema | 220/80 X |
| 3,994,241 | 11/1976 | Evans | 108/53.5 |
| 3,999,676 | 12/1976 | Trebileock et al. | 220/1.5 X |
| 4,046,278 | 9/1977 | Chieger et al. | 220/1.5 |

FOREIGN PATENT DOCUMENTS

| | | | |
|---|---|---|---|
| 1429839 | 1/1966 | France | 220/1.5 |
| 1581478 | 9/1969 | France | 220/1.5 |
| 1193069 | 5/1970 | United Kingdom | 220/1.5 |

*Primary Examiner*—Allan N. Shoap

*Attorney, Agent, or Firm*—Ronald E. Suter; Bernard A. Donahue

[57] ABSTRACT

A lightweight cargo container and the fittings for the construction of same are disclosed. One fitting is an extrudable side rail member which connects the container side walls to the bottom wall or floor. Another fitting is a two-part, lightweight, protective corner block which provides attachment points for handling and permits simple replacement of the exposed portion thereof, in the event of damage.

4 Claims, 6 Drawing Figures

Fig. 2
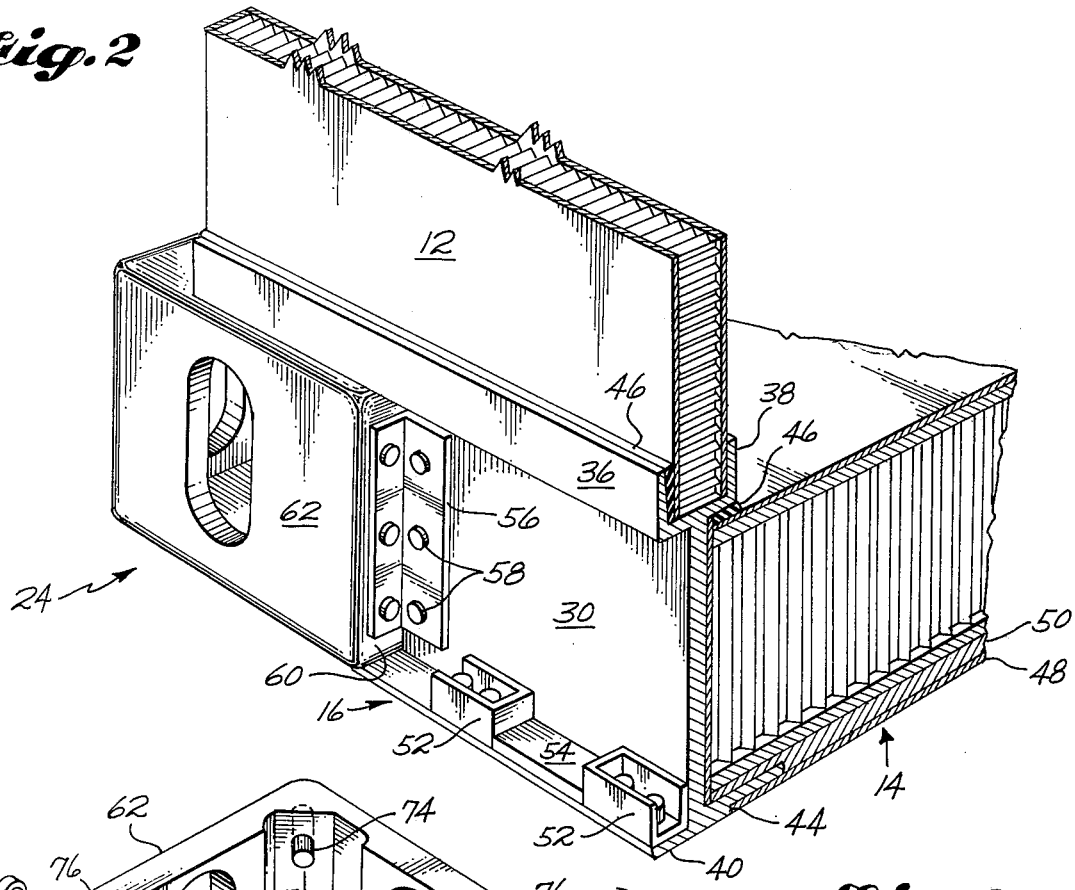
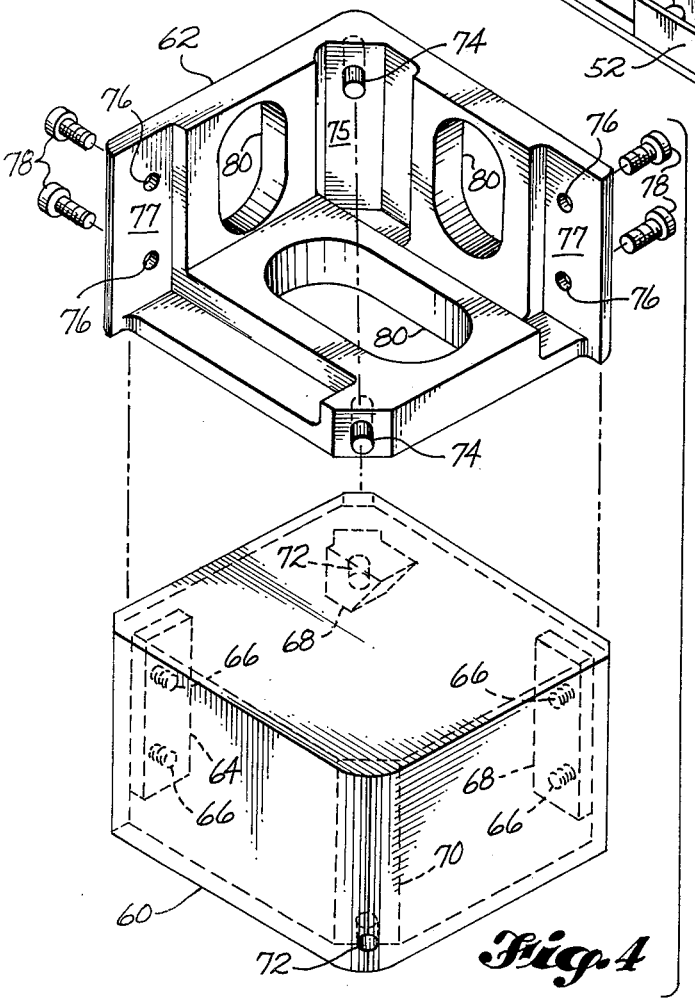
Fig. 4
Fig. 3
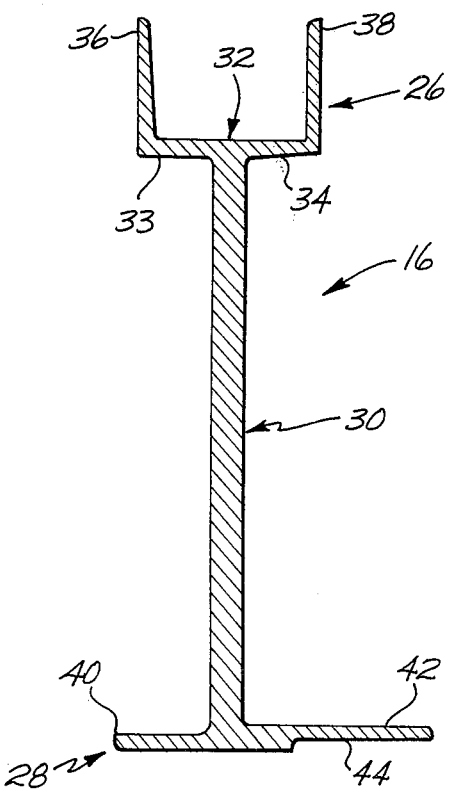

LIGHTWEIGHT CARGO CONTAINER AND FITTINGS

CROSS-REFERENCE TO RELATED APPLICATION

This application is related to U.S. patent application Ser. No. 069,218 filed concurrently herewith, entitled "Lightweight Cargo Container and Fittings" by Clyde R. Ketner and Philip Whitener.

BACKGROUND OF THE INVENTION

1. Field of the Invention

This invention relates generally to cargo containers and their construction and, more particularly to the construction of lightweight cargo containers dimensioned to International Standards Organization (ISO) specifications. Although this invention finds particular utility in cargo containers intended for air transport, it is expressly to be understood that the advantages of the invention are equally manifest in other types and sizes of containers, wherever strength, low cost and reduced weight are desired.

2. Background of the Invention

Cargo is frequently shipped in bulk containers to reduce handling and expedite loading and unloading operations. To facilitate handling of these containers, various characteristics such as dimensions, strength requirements and fittings have been standardized under guidelines promulgated by the ISO. In order to comply with these guidelines, most containers of this type are constructed of steel or aluminum and are quite heavy. Joints are frequently welded or bolted and sealed, requiring substantial assembly time and adding weight. Because they are rather bulky and heavy, initial use of these containers has been limited to various means of land or sea transport. The introduction of wide-body aircraft has caused air shipment of ISO containers to be more seriously considered, however their weight continues to reduce aircraft payload to such an extent as to make their use economically impractical under most circumstances.

Prior attempts to produce a lightweight container capable of meeting the Standards have met with little success. Frequently these lightweight containers are unable to satisfactorily withstand the abuse of repeated loading and unloading. Container corner fittings of lightweight material frequently suffer handling damage requiring the container to be removed from service for extensive repairs. Prior lightweight containers require a complex assembly procedure which is both time consuming and costly.

It is, accordingly, an object of the invention to provide a lightweight cargo container that overcomes the disadvantages and limitations of the prior art.

It is another object of the invention to provide an easily manufactured fitting that permits secure attachment of container walls to each other.

It is another object of the invention to provide a lightweight, easily replacable protective corner fitting for a cargo container.

It is a further object of the invention to provide a lightweight cargo container having easily replacable lightweight container restraint blocks.

It is yet another object of the invention to provide a lightweight cargo container that may be easily assembled.

SUMMARY OF THE INVENTION

Briefly, these and other objects are achieved in accordance with the structural aspects of an example of the invention in which an easily manufactured side rail member securely connects side and bottom container walls. These walls may be of any lightweight, yet strong construction. The simple cross-sectional shape of the side rail permits inexpensive manufacture by extrusion while reducing unnecessary weight. Two part container corners permit rapid and inexpensive replacement in the event of damage. The inventive two part corners conform to required specifications while providing necessary points of attachment internally thereof.

Further details of these and other novel features, their operation and cooperation as well as additional objects and advantages will become apparent from a consideration of the following description and accompanying drawing which is provided by way of illustrative example only.

BRIEF DESCRIPTION OF THE DRAWING

FIG. 2 is a cutaway perspective view of a portion of the container of FIG. 1 showing the side rail fitting and walls in more detail.

FIG. 3 is a cross-sectional view of the side rail fitting.

FIG. 4 is an exploded perspective view of the protective corner fitting.

DESCRIPTION OF THE PREFERRED EMBODIMENTS

Figure 1:
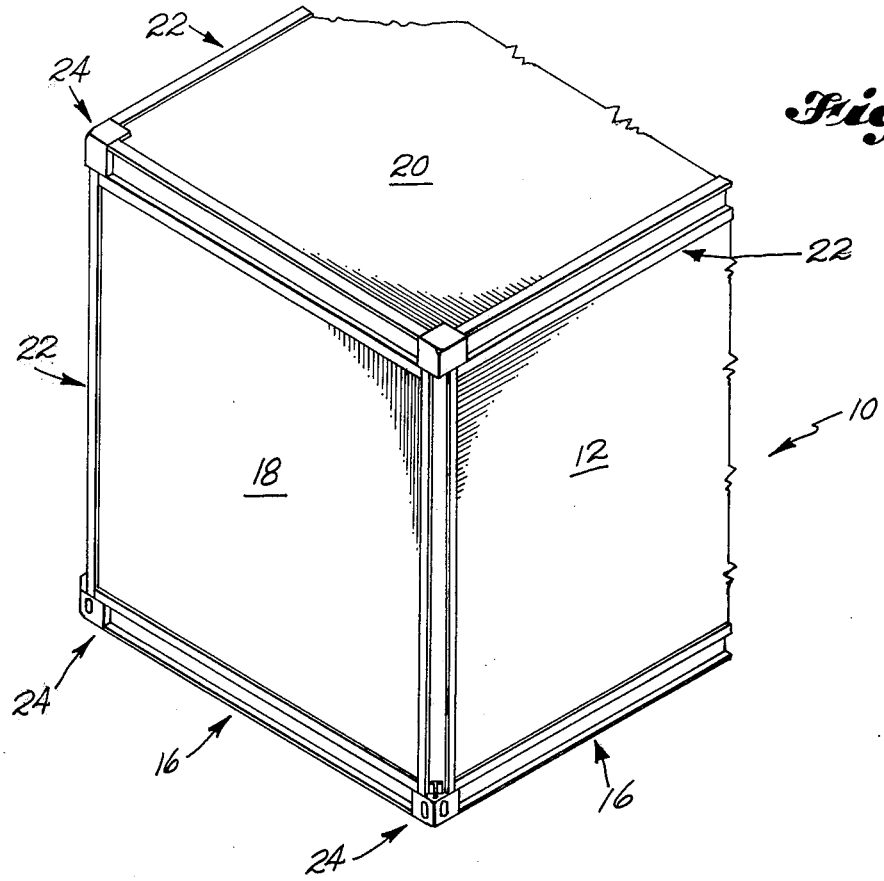
FIG. 1 is a partial perspective view of a lightweight container embodying the fittings of the invention.

With reference now to the figures in detail, it is again stressed that the particulars shown are by way of illustrative example only and are not to be taken as a limitation on the scope of the invention which is defined by the appended claims forming, along with the drawing, a part of this specification.

In FIG. 1 a container, generally designated 10, is shown. Container 10 includes side walls 12 (only one shown) secured to bottom wall or floor 14 (see FIG. 2) by a side rail, generally designated 16. Side walls 12 are secured to end walls 18 (only one shown) and top wall 20 by wall connecting fittings, generally designated 22. Similarly, end walls 18 are secured to top wall 20 by fittings 22. Obviously, one or both end walls 18 may be provided with some conventional form of door to permit access to the interior of container 10. End walls 18 may also be connected to bottom wall 14 by side rails 16. At each corner of container 10 a protective corner fitting, generally designated 24 is provided.

Turning now to FIGS. 2 and 3, side rail 16 will be described in more detail. Rail 16 includes a rigid upper, generally U-shaped portion 26, a lower, generally planar base 28 and a web 30 extending between and integrally connecting said upper portion 26 and said base 28. U-shaped portion 26 is formed by a bight 32, which is in turn formed by two bight portions 33, 34, extending generally orthogonally away from opposite sides of one end of web 30, and two arms 36, 38. Each of said arms 36, 38 extends away from a respective one of said bight portions 32, 34 in a direction substantially perpendicular to said bight and paralled to said web 30. Base 28 is formed by two base portions 40, 42 extending generally orthogonally away from opposite sides of the other end of web 30. As seen most clearly in FIG. 3, arm 36 tapers gradually from root to tip so that the space between arms 34 and 36 becomes greater toward the tips thereof. Similarly, the lower surface, i.e., that surface opposite arm 38, of bight portion 34 tapers gradually away from the upper surface of base portion 42. The opposite or lower surface of base portion 42 is provided with a cut out or recess 44, the purpose of which will be described in greater detail infra. The simple cross-sectional shape of side rail 16 permits inexpensive manufacture, for example by simple extrusion, from any desired lightweight yet sufficiently strong material such as aluminum. Such extrusions could, of course, be formed as long sections and then be cut to the desired lengths.

The utilization of side rail 16 in the construction of container 10 is shown more clearly in FIG. 2. Side and bottom walls, 12 and 14 respectively, may be of any known, lightweight construction, such as honeycomb/-face sheet laminate. The side wall 12 is secured in the upper, U-shaped portion 26 of side rail 10 by a suitable, conventional adhesive and a wedge 46. The aforementioned taper of arm 36 permits wedge 46 to be forced between the tapered interior surface thereof and the outer surface of wall 12 after adhesive has been applied. Wedge 46 thus serves not only to provide a clamping force during curing of the adhesive, but also to absorb any tolerance mismatch between the wall and fitting. This permits side rail 16 and walls 12 to be manufactured without the need to maintain close tolerances and requires no subsequent machining operations. In a substantially similar manner, bottom wall 14 is adhesively secured between the lower tapered surface of bight portion 34 and base portion 42. Due to the extra loads carried by the bottom wall or floor 14 and to the need for a smooth lower container surface, base portion 42 is inserted between laminations 48 and 50 which form part of the lower face sheet of the honeycomb composite. Recess 44 is substantially identical in depth, to the height of lamination 48, such that, in the assembled condition (FIG. 2), a smooth transition between the lower surfaces of side rail 16 and floor 14 is formed. This permits container 10 to be easily moved over cargo handling rollers when necessary.

Containers of the type described are required by ISO specifications to provide means for securing the container to the transporting vehicle. Side rail 16 permits this requirement to be met with minimum added weight while, at the same time, permitting simple replacement thereof in the event of damage. As shown in FIG. 2, a pair of restraint blocks 52 are removably secured to the upper surface of base portion 40. Blocks 52 are separated by a rub strip 54. This arrangement serves not only to provide the surface against which a container hold down (not shown) acts and to confine the hold down between the blocks, but also to raise the attachment surface to the ISO specified height. In the event either block 52 or strip 54 is damaged, it may be easily replaced without removing container 10 from service for any lengthy period of time.

To provide secure attachment between side rail 16 and corner 24, a clip 56 is provided. A plurality of bolts 58 secure clip 56 to web 30 and corner 24. Other means of securing clip 58, such as welding, could also be used. It is also noted that sections of base 28 and web 30 have been cut away to permit the upper portion of rail 16 to extend over corner 24 to strengthen the connection therebetween.

FIG. 4 shows an exploded view of protective corner 24. Corner 24 includes a fixed portion 60, adapted to be permenently fixed to the container 10, and a removable portion 62. Since fixed portion 60 is substantially protected on all sides from severe impact, it may be formed of almost any lightweight material, such as aluminum or fiberglass. It must, however, be capable of securely holding removable portion 62 in place. Fixed portion 60 is provided with a pair of outwardly extending flanges 64, each of which carries a plurality of fastening means such as nutplates or threaded bores 66. Portion 60 also carries a further flange 68 and a fillet 70, which are each provided with a smooth bore 72. Removable portion 62 carries a pair of pins 74, one of which is carried in a fillet 75. Pins 74, in the assembled condition, mate with and extend into bores 72, to carry shear loads. Portion 62 also carries a plurality of bores 76 in recesses 77 which, in the assembled condition, align with bores 66. Bolts 78 pass through bores 76 and are threadably received in bores 66 to secure the two-part corner together and carry moments. Holes 80 are provided in their standard ISO locations to serve as attachment points for the handling, lifting, etc. of container 10.

Figure 5:
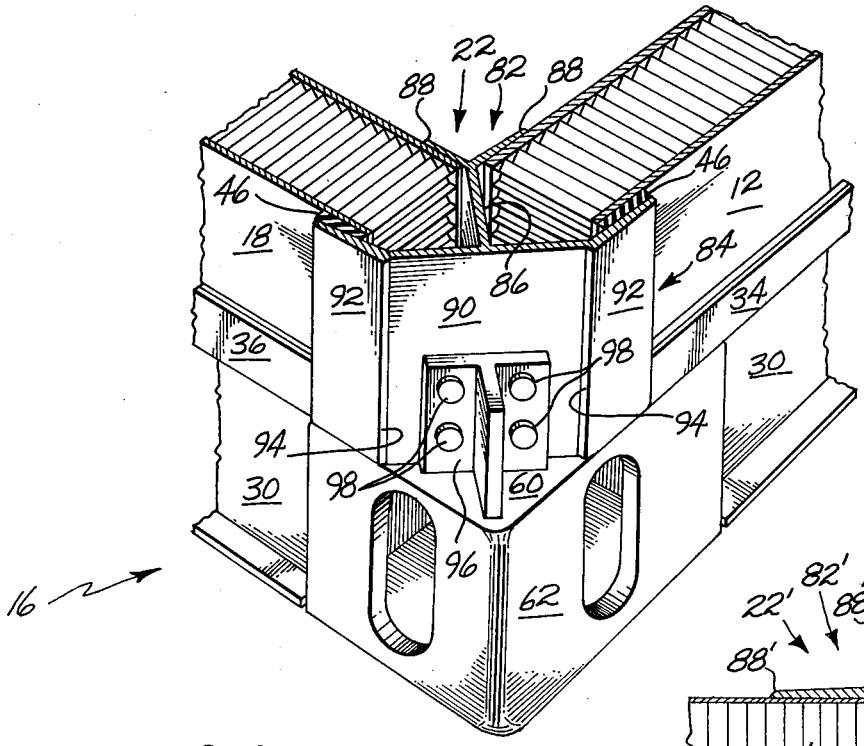
FIG. 5 is a perspective view of the wall connecting fitting.

Turning now to FIG. 5, a portion of container 10 exhibiting one embodiment of a wall connecting fitting 22 is shown in more detail. For purposes of simplicity, this fitting is shown only in relation to a side wall 12 and an end wall 18, however, as noted with regard to FIG. 1, this same fitting may be used at other locations. Fitting 22 is formed by an inner flange generally designated 82, an outer flange generally designated 84 and a connecting web 86 integrally extending therebetween. Inner flange 82 is formed by a pair of inner flange portions 88 which extend obliquely away from opposite sides of the inner end of web 86. Outer flange 84 is formed by a central portion 90 which is integrally attached substantially at its midpoint, to the outer end of web 86. Central portion 90 extends on opposite sides of its midpoint in a direction substantially perpendicular to web 86. Integrally formed on each of the opposite sides of central portion 90 is an outer flange portion 92, each of which extend obliquely away from central portion 90. Inner and outer flange portions, 88 and 92 respectively, on each side of web 86 are oriented to be substantially parallel. However, the inner surfaces of flange portions 92 are tapered from their connection with central portion 90 toward their respective tips so that the space between portions 88 and 92 on each side of web 86 increases in a direction away from web 86. Walls 12 and 18 may be secured within these spaces between portions 88 and 92, using an adhesive and a wedge 46, as discussed supra with regard to side rail 16. To facilitate the insertion of wedges 46, fitting 22 may be provided with reaction surfaces 94 at the junctions between central portion 90 and outer flange portions 92. Surfaces 94 provide a means whereby one part of a clamping tool (not shown) may be rested while the other part thereof applies an appropriate force against a wedge 46. As shown, a T-flange 96 may be secured, as by welding, to the fixed portion 60 of corner 24. Flange 96 is provided with bores (not shown) through which bolts 98 may pass into a fastening means such as threaded bores or blind fasteners (not shown) in fitting 22. In this manner applied loads are effectively carried and distributed between the various container components. Once again the simple cross-sectional design of fitting 22 permits inexpensive manufacture, such as by extrusion.

Figure 6:
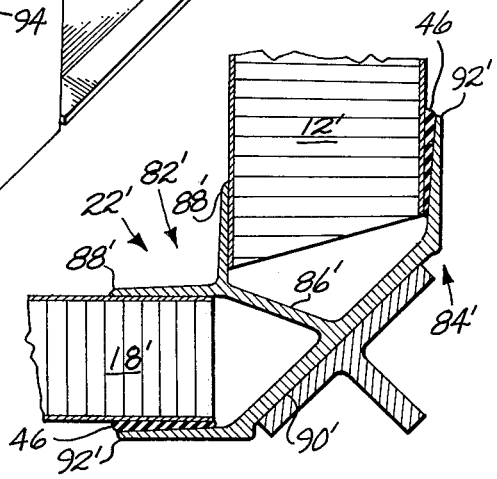
FIG. 6 illustrates another embodiment of the fitting of FIG. 5.

In some applications, the various wall members may be different thicknesses. The wall connecting fitting 22′ shown in FIG. 6 will accommodate such an arrangement. As discussed with regard to fitting 22, the embodiment 22′ includes an inner flange 82′, an outer flange 84′ and a connecting web 86′ integrally extending therebetween. Since side wall 12′ is thicker than end wall 18′, the outer end of web 86 extends obliquely away from the central portion 90′ of outer flange 86′. As is also apparent, inner flange portions 88′ extend at different angles with respect to the inner end of web 86′. The angles at which portions 88′ extend are selected to once again produce an increasing distance between themselves and their respective outer flange portions 92′ in a direction from root to tip. As before, a wedge 46′ is shown between the wall member 18 or 12 and the outer flange portion 92′, however, it could equally well be located between the wall member 12, 18 and the inner flange portion 88′ if desired.

There has thus been disclosed and described a lightweight, easily assembled cargo container, its construction and the fittings therefor, which exhibit the advantages and achieves the objects set forth hereinabove.

What is claimed is:

1. A side rail fitting adapted to secure the walls to the floor in a lightweight cargo container comprising a rigid upper portion having a substantially U-shaped cross section formed by a generally planar bight and two arms integral with the ends thereof, said arms having substantially smooth facing surfaces and extending substantially perpendicularly with respect to said bight, at least one of said arms being tapered from root to tip in a direction away from said bight such that the distance between said arms increases in said direction;

a rigid, lower, substantially planar base, extending generally parallel with respect to said bight; and a web integral with and extending substantially perpendicularly between said bight and said base, at least a portion of the surface of said bight opposite that from which said arms extend being tapered away from said base in a direction away from said web, such that the distance between said bight surface and said base increases in said direction away from said web, the integral connection between said bight and said web being located on said bight surface substantially midway between the integral connections of said arms to said bight and the integral connection between said base and said web dividing said base into two base portions; wherein one of said base portions has a recess in the surface thereof opposite that to which the web connects forming one free end of reduced thickness;

a lightweight wall inserted in said upper portion, a lightweight floor inserted substantially between the tapered surface of said bight and one of said base portions, a first wedge inserted between said tapered arm and said wall, a second wedge inserted between the tapered surface of said bight and said floor, and adhesive means for securing said first and second wedges, said wall and said floor within said fitting; and at least one pair of restraint blocks removably mounted in spaced relation on the other base portion and a rub strip removably mounted between said restraint blocks for providing a hold-down attachment for said container.

2. A side rail fitting as claimed in claim 1, further comprising a protective corner fitting for said container, said corner fitting being attached to the end of said side rail fitting, said corner fitting comprising a fixed part, adapted to be permanently attached to the container; said fixed part comprising first and second substantially rectangular walls integrally connected to each other along an edge of each and extending generally at right angles to each other from their connection; a third substantially rectangular wall integrally connected along two of its edges to said first and second walls and extending generally at right angles to each of said first and second walls, a removable part, adapted to be removably attached to said fixed part, said removable part comprising fourth and fifth substantially rectangular walls integrally connected to each other along an edge of each and extending generally at right angles to each other from their connection, a sixth substantially rectangular wall integrally connected along two of its edges to said fourth and fifth walls and extending generally at right angles to each of said fourth and fifth walls; said fourth, fifth and sixth walls having means for handling provided therein; and means for removably connecting said removable part to said fixed part such that when said parts are connected together, said third wall contacts the edges of said fourth and fifth wall opposite the edges to which said sixth wall is connected and said sixth wall contacts the edges of said first and second walls opposite the edges to which said third wall is connected to form a generally rectangular hollow protective corner.

3. A protective corner fitting as claimed in claim 2, said means for connecting said parts comprising a first flange fixed to each of the edges of said first and second walls opposite the connection therebetween, each first flange extending at substantially a right angle to the wall to which it is attached and each first flange carrying at least one fastening means;

a first fillet on the inside of the connection between said first and second walls, said first fillet having at least one bore therein;

a second flange connected to the inside of said third wall adjacent the corner thereof diagonally opposite said first fillet, said second flange having at least one bore therein;

a recess in the inside of said fourth and fifth walls at the edges thereof opposite the connection therebetween, each said recess being shaped and dimensioned to receive said first flanges and having at least one bore therethrough which is so located to align with the at least one fastening means on a respective one of said flanges when said parts are connected a second fillet on the inside of the connection between said fourth and fifth walls, said second fillet having at least one first pin extending therefrom, said at least one first pin being oriented and dimensioned so as to be received in the at least one bore in said second flange when said parts are connected; and at least one second pin extending from the corner of said sixth wall diagonally opposite said second fillet; said at least one second pin being oriented and dimensioned to be received in said at least one bore in said first fillet when said parts are connected.

4. A protective corner fitting for a lightweight cargo container comprising a fixed part, adapted to be permanently attached to the container; said fixed part comprising first and second substantially rectangular walls integrally connected to each other along an edge of each and extending generally at right angles to each other from their connection; a third, substantially rectangular wall integrally connected along two of its edges to said first and second walls and extending generally at right angles to each of said first and second walls, a removable part, adapted to be removably attached to said fixed part, said removable part comprising fourth and fifth substantially rectangular walls integrally connected to each other along an edge of each and extending generally at right angles to each other from their connection; a sixth substantially rectangular wall integrally connected along two of its edges to said fourth and fifth walls and extending generally at right angles to each of said fourth and fifth walls; said fourth, fifth and sixth walls having means for handling provided therein; and means for removably connecting said removable part to said fixed part such that when said parts are connected together, said third wall contacts the edges of said fourth and fifth walls opposite the edges to which said sixth wall is connected and said sixth wall contacts the edges of said first and second walls opposite the edges to which said third wall is connected to form a generally rectangular, hollow, protective corner, said means for connecting said parts comprising a first flange fixed to each of the edges of said first and second walls opposite the connection therebetween, each first flange extending at substantially a right angle to the wall to which it is attached and each first flange carrying at least one fastening means;

a first fillet on the inside of the connection between said first and second walls, said first fillet having at least one bore therein;

a second flange connected to the inside of said third wall adjacent the corner thereof diagonally opposite said first fillet, said second flange having at least one bore therein;

a recess in the inside of said fourth and fifth walls at the edges thereof opposite the connection therebetween, each said recess being shaped and dimensioned to receive said first flanges and having at least one bore therethrough which is so located to align with the at least one fastening means on a respective one of said first flanges when said parts are connected;

a second fillet on the inside of the connection between said fourth and fifth walls, said second fillet having at least one first pin extending therefrom, said at least one first pin being oriented and dimensioned so as to be received in the at least one bore in said second flange when said parts are connected; and at least one second pin extending from the corner of said sixth wall diagonally opposite said second fillet; said at least one second pin being oriented and dimensioned to be received in said at least one bore in said first fillet when said parts are connected.

* * * * *